US009446278B2

(12) United States Patent
Wroclawsky

(10) Patent No.: US 9,446,278 B2
(45) Date of Patent: Sep. 20, 2016

(54) BICYCLE SPEED/RESISTANCE ATTACHMENT

(71) Applicant: Sol Wroclawsky, Long Beach, CA (US)

(72) Inventor: Sol Wroclawsky, Long Beach, CA (US)

( * ) Notice: Subject to any disclaimer, the term of this patent is extended or adjusted under 35 U.S.C. 154(b) by 157 days.

(21) Appl. No.: 13/652,417

(22) Filed: Oct. 15, 2012

(65) Prior Publication Data

US 2014/0106947 A1 Apr. 17, 2014

Related U.S. Application Data

(63) Continuation-in-part of application No. 13/374,984, filed on Jan. 26, 2012, now abandoned.

(60) Provisional application No. 61/462,142, filed on Jan. 28, 2011.

(51) Int. Cl.

| | |
|---|---|
| ***A63B 22/06*** | (2006.01) |
| ***A63B 69/16*** | (2006.01) |
| ***A63B 21/02*** | (2006.01) |
| ***A63B 21/04*** | (2006.01) |
| ***A63B 23/035*** | (2006.01) |
| ***A63B 23/04*** | (2006.01) |
| *A63B 21/055* | (2006.01) |
| *A63B 21/065* | (2006.01) |
| *A63B 21/00* | (2006.01) |

(52) U.S. Cl.

CPC ..... *A63B 21/0442* (2013.01); *A63B 21/0552* (2013.01); *A63B 21/0557* (2013.01); *A63B 21/4011* (2015.10); *A63B 23/03541* (2013.01); *A63B 23/0476* (2013.01); *A63B 69/16* (2013.01); *A63B 21/00069* (2013.01); *A63B 21/02* (2013.01); *A63B 21/04* (2013.01); *A63B 21/055* (2013.01); *A63B 21/065* (2013.01); *A63B 21/4025* (2015.10); *A63B 22/0605* (2013.01)

(58) Field of Classification Search

CPC ..... A63B 21/0557; A63B 21/0442; A63B 21/1449; A63B 21/1423; A63B 21/00185; A63B 69/16; A63B 23/0476; A63B 21/0552; A63B 23/03541; A63B 21/00069; A63B 22/0605; A63B 21/02; A63B 21/1609; A63B 22/06; A63B 23/04; A63B 23/0494; A63B 2069/164; A63B 2069/165; A41F 9/00; B62M 1/105

USPC ..... 482/57–78, 121–139; 2/312

See application file for complete search history.

(56) References Cited

U.S. PATENT DOCUMENTS

| | | | | |
|---|---|---|---|---|
| 3,659,846 | A * | 5/1972 | Kanicki | 482/129 |
| 4,909,526 | A * | 3/1990 | Vazin | 280/230 |
| 5,158,510 | A * | 10/1992 | Lemire | 482/51 |

(Continued)

*Primary Examiner* — Oren Ginsberg
*Assistant Examiner* — Joshua Lee
(74) *Attorney, Agent, or Firm* — Apogee Law Group P.C.; Jeffrey C. Wilk

(57) ABSTRACT

An exercise assembly useful in training a bicyclist for increased speed includes a pair of elastic straps adjustable in their length to stretch between the rear axle of the bicycle and the bicyclist's respective thighs. The strap attachment to the thighs is effected by a corresponding pair of adjustable elastic hoops that are limited in their elastic expansion by fabric strips attached to each of the hoops at loosely spaced intervals. A set of elastomeric wraps may be further interposed between the thighs and the hoops to expand the contact area and therefore the shear load capacity of the engagement to limit any axial translation of the engagement along the thigh. When not in use the straps can be attached to the bicycle frame both when implemented as a stationary bicycle or when on the road.

11 Claims, 4 Drawing Sheets

(56) References Cited

U.S. PATENT DOCUMENTS

| | | | | |
|---|---|---|---|---|
| 5,167,601 | A * | 12/1992 | Frappier | 482/121 |
| 5,197,931 | A * | 3/1993 | Wroclawsky | 482/74 |
| 5,951,443 | A * | 9/1999 | Askins | 482/74 |
| 6,179,760 | B1 * | 1/2001 | Rumbaugh | 482/121 |
| 6,368,256 | B1 * | 4/2002 | Rumbaugh | 482/121 |
| 6,652,427 | B2 * | 11/2003 | Wroclawsky | 482/111 |
| 6,738,987 | B1 * | 5/2004 | Parks | 2/312 |
| 7,998,030 | B2 * | 8/2011 | Wroclawsky | 482/51 |
| 8,100,816 | B2 * | 1/2012 | Daniel | 482/93 |
| 2003/0166435 | A1 * | 9/2003 | Arad | 482/57 |
| 2008/0269029 | A1 * | 10/2008 | Heck | 482/129 |

* cited by examiner

BICYCLE SPEED/RESISTANCE ATTACHMENT

REFERENCE TO RELATED APPLICATIONS

This application is a continuation-in-part of U.S. application Ser. No. 13/374,984 filed Jan. 26, 2012, which, in turn, obtains the benefit of the earlier filing date of U.S. Provisional Application No. 61/462,142 filed on Jan. 28, 2011 and the benefit of these earlier filing dates is therefore accorded for all matter common therewith.

STATEMENT CONCERNING GOVERNMENT INTEREST

None.

BACKGROUND OF THE INVENTION

1. Field of the Invention

The present invention relates to an attachment arrangement extending a pair of elastic bands or tethers each stretched from a respective thigh of a bicyclist to a pair of laterally spaced points on the bicycle for providing resistance to the forward movement of the bicyclist's legs.

2. Description of the Prior Art

In my prior U.S. Pat. No. 5,197,931, issued Mar. 30, 1993, I have described an exercise apparatus in which a rolling frame is trailed behind a user to fix the ends of a set of elastomeric bands, or straps, that at their other ends each respectively attach to the arms and legs of the user to elastically restrain the forward motion of each of these limbs while running. Thereafter I described in U.S. Pat. No. 6,652,427, issued to me on Nov. 25, 2003, an improved form of the foregoing elastomeric restraint arrangement in which the elastic band is branched to the legs from a single elastic strap extending rearward to an attachment at the end of a treadmill, with the single elastic strap delayed in its motion by the lagging motion of a fabric panel to align the strap out of the way of the user's other leg, an improvement that was then carried over for use on a track by way of a roller supported trailing frame described in U.S. Pat. No. 7,998,030 that was issued to me on Aug. 16, 2011.

Each of the foregoing stem from my observation, and also the observations of many others, that any neuromuscular movement sequence of a human body follows very predictable, coordinated patterns dictated by the anatomical disposition of the muscle groups involved in the movement, their skeletal attachments, their various elastic coefficients, mass distribution, moments of inertia, and so on, as it is these interrelationships that were earlier honed by evolution to make us the highly efficient, bipedal species that we are. Of course, improvement by training of such coordinated muscle groups is best achieved by their natural repetition while their main muscle group effort is enhanced. In this manner the muscle group involved in the running movement, for example, is best trained while running with the main thigh muscles loaded by an elastic restraint to a higher effort to extend the distance of the runner's gait, as in my prior U.S. Pat. No. 7,998,030, with the remainder of the muscle complement then following suit.

In the past such elastic restraints were typically deployed between one and another part of the user's body, as for example, the resistance arrangement disclosed in U.S. Pat. No. 6,280,365 to Weber et al.; U.S. Pat. No. 7,314,437 to Frappier; U.S. Pat. No. 7,850,583 to Smith; and many others, or the restraint is fixed to a stationary object, as in U.S. Pat. No. 6,612,845 to Macri et al.; U.S. Pat. No. 7,087,001 to Thli; and others. While suitable for the purposes intended, each of the foregoing limits the extent of its use by its very nature and their application is wholly inapposite to train the wholly unconstrained movement of running, or particularly bicycling, movement that is characterized by well coordinated muscle groupings that achieve a self-reinforcing gait or cyclic pattern from their common coefficients of restitution resulting from coordinated and matching mass-elastic coefficients and dynamic responses of the whole muscle group.

An elastic restraint arrangement useful in developing and strengthening the coordinated movements that complement the operation of a matched carriage like a bicycle are therefore extensively desired and it is one such arrangement that is disclosed herein.

BRIEF SUMMARY OF THE INVENTION

Accordingly, it is the general purpose and object of the present invention to provide a set of elastic restraint straps adjustable to stretch between the rear frame portion of a bicycle to the thighs of the mounted bicyclist to provide resistive forces to the upward and forward movement of the bicyclist's legs.

Yet other and further objects of the present invention shall become apparent upon the review of the description following in conjunction with the illustrations appended.

Briefly, these and other objects are accomplished within the present invention by releasably mounting onto each of the free ends of the rear axle shaft of a bicycle an attachment fixture attached to one end of a corresponding elastic strap which at its other end is looped through the base of a spring loaded swivel clip and returned in a length adjusting loop by way of a clasp or cam buckle like those sold under the style or model designations 40880-22; 42195-11; or 40880-15 by Ancra International, LLC, Hawthorne, Calif., selectively grasping the strap portion extending therethrough. The swivel clip may then be selectively attached either to an attachment hook mounted on the bicycle frame, when not in use, or may be engaged to a D-ring sown into an elastic hoop that is cinched around the corresponding thigh of the bicyclist, thereby providing a resistive tension opposing the upward and forward part of the leg and pedal movement while assisting the pedaling effort over the return part of the pedal arc. In this manner the muscular stress level involved in the forward movement is enhanced while the effort of the muscle group of the return stroke is reduced.

For those users of this exercise restraint that may not have thigh musculatures forming a substantial taper towards the knee, and therefore allow for some translation of the elastic hoop along the thigh in the course of the training process, an intermediate elastomeric canvas wrap may be stretched over the thigh to which the hoop can then be selectively affixed by way of the well known hook and pile attachment referred to by the name or style 'Velcro'. A similar fastening method can also be used to fasten the wrap in its stretched extension on the thigh where it is retained in its selected position by a plurality of sponge pads attached at distributed locations of the wrap interior to effect an enhanced engaging contact with the user's skin at each of the sponge opening edges.

In this form various anatomical shapes are conveniently accommodated in the engagement mechanism so that all the desired levels of exercise vigor can be carried out. Of course, the utilization of sponge pads at the most direct contacts with the user's skin provides a moisture absorbing interface where it is most needed to absorb the sweat moisture that invariably follows all training vigor.

Those skilled in the art will appreciate that an organism developed in an evolutionary setting will flourish if its several components, as a group, maximize its energy consumption efficiency and a conservative running gait, as well as the cyclic pedaling of a well designed bicycle, that maximize rebound energy, otherwise referred to as maximizing its coefficient of restitution, will prevail. An exercise mechanism that imposes a biasing load by resisting the forward motion of the whole muscle group will inherently bias this efficiency towards a faster rate, a result that has been and continues to be heuristically supported. Thus the instant invention results in a bias towards faster movement down the track, providing a convenient mechanism for those training for competition. Of course, any significant modification of muscular movement sequences can only be achieved through extensive repetition which the foregoing moisture absorbing contact pads absorb thus extending the possible training intervals to a point where the mechanism of fatigue then resolve this muscular adaptation to its most efficient form.

DESCRIPTION OF THE PREFERRED EMBODIMENT

Figure 1:
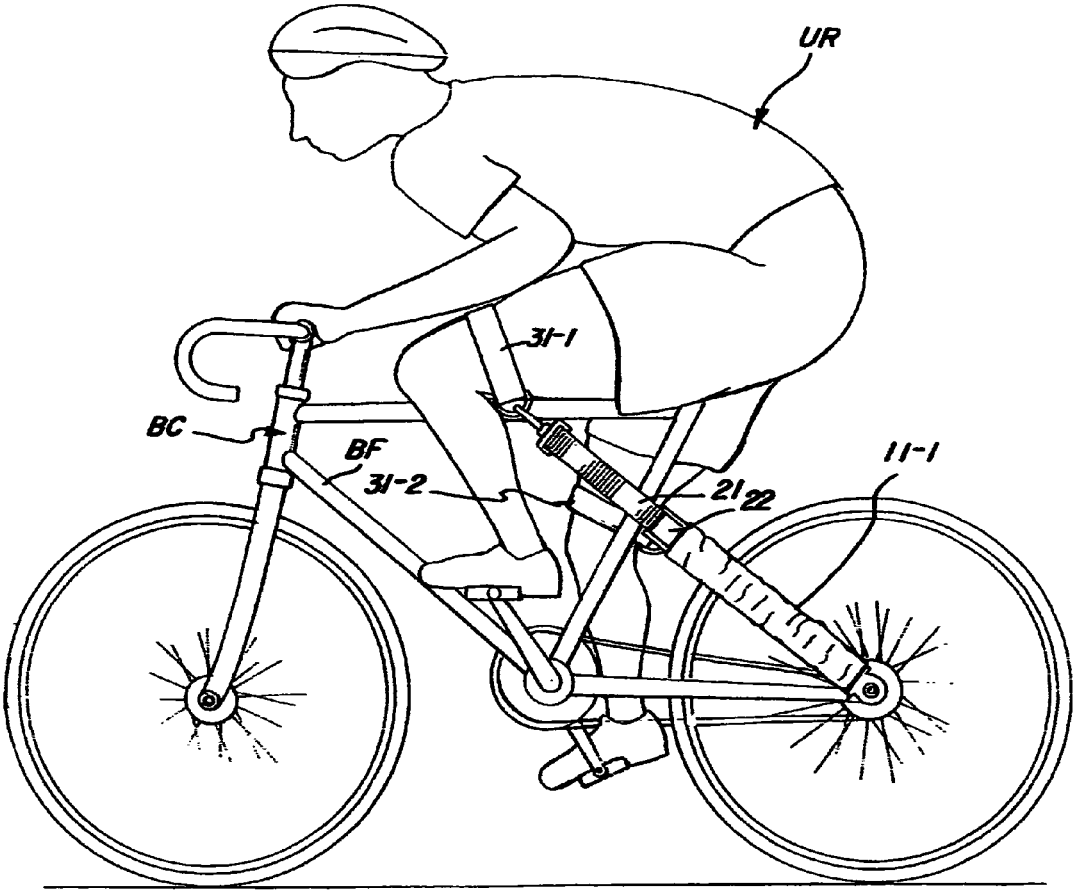
FIG. 1 is a perspective side view of a bicycle provided with the inventive elastic restraint assembly conformed for selective rearward restraint of the thighs of a bicyclist mounted thereon.
Figure 2:
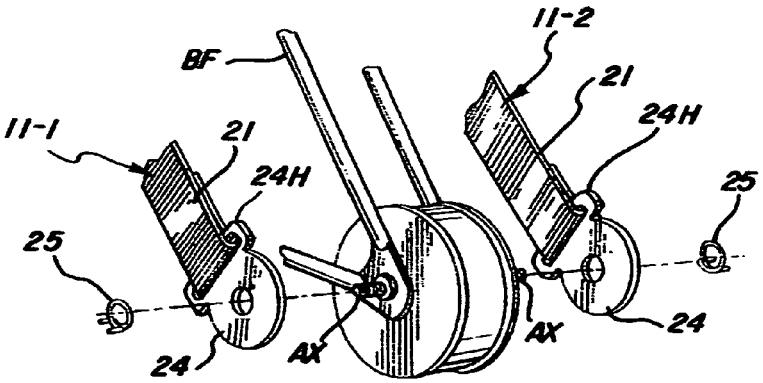
FIG. 2 is a perspective detail view, separated by parts, illustrating the manner of attachment of the inventive restraint assembly to the rear axle of the bicycle as shown in FIG. 1.
Figure 4:
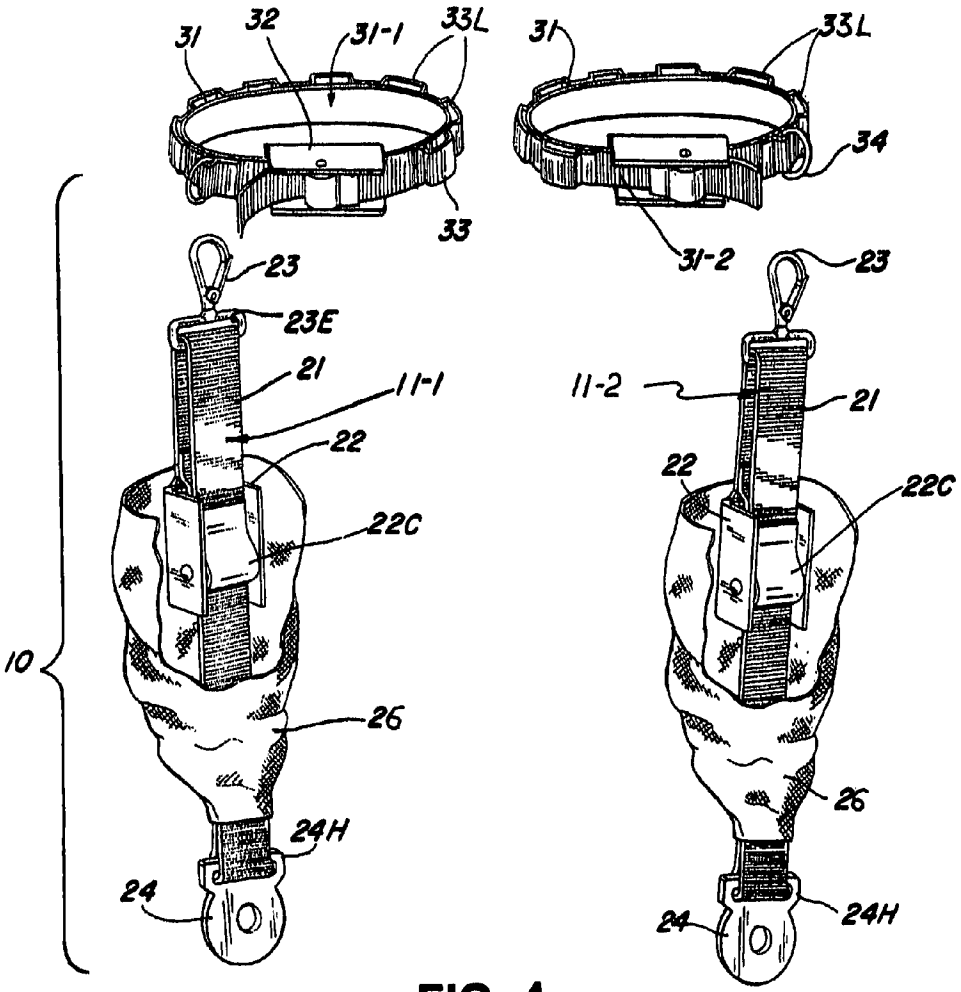
FIG. 4 is a perspective illustration of the inventive restraint assembly in its undeployed and unconnected form, depicting the use of a protective fabric sheath to cover the operative parts thereof.
Figure 3:
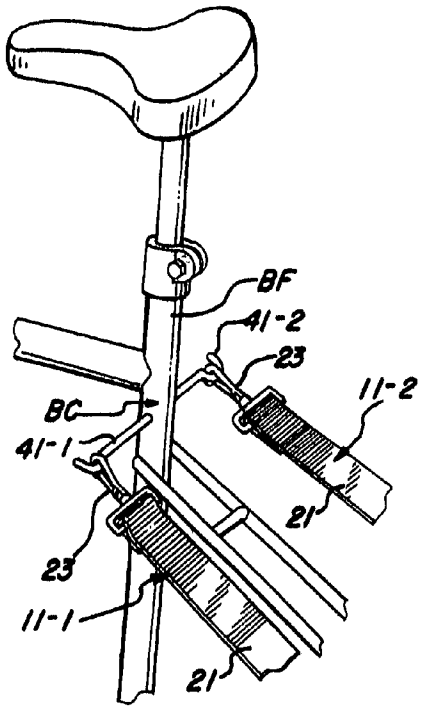
FIG. 3 is yet another perspective detail view illustrating a pair of hooks affixed in opposition to project laterally from the rear portion of the bicycle frame for providing an engagement for the free ends of the inventive restraint assembly when not in use, accommodating the use of the inventive assembly in the course of a self-training process.

As shown in FIGS. 1-4, the inventive restraint assembly, generally designated by the numeral 10, comprises a first and second elastic strap combination 11-1 and 11-2 each defined by an elastomeric strap 21 engaged at one end to a cam buckle 22 which, in a like manner to the cam buckles referred to above, is provided with a slot though which the same looped strap 21 is returned to pass underneath a spring loaded cam 22C after first passing through the eyelet 23E of a swivel clip 23. In this form the length of the strap loop separating the cam buckle 22 from the swivel clip 23 may be conveniently adjusted to select the strap dimension between the swivel clip 23 extending partially within a cloth sheath 26 affixed to the other end that of strap 21 that is also engaged to a hoop 24H on the periphery of a washer 24 conformed to receive one end of the rear axle shaft AX of a bicycle BC, to be retained in this engaged position by a spring circlip 25.

A pair of hoops 31-1 and 31-2 conformed to be cinched around the thighs of the using bicyclist UR, as he or she is mounted on bicycle BC, are again each defined by an elastomeric strap 31 respectively attached at their one ends to one of a further set of cam buckles 32 with the other ends of each of the straps then returned for capture within the same cam buckles 32 for convenient adjustment of their hoop dimension around the the user's thighs.

To obtain a secure, tightly fitting, engagement with the user's thighs each of the hoops 31-1 and 31-2 further includes corresponding fabric strips 33 sewn in spaced, convolved loops 33L to a substantial portion of the corresponding elastomeric strap 31, thereby limiting the range of its extension thereof to assure a tight fit throughout the various muscular movements. A D-ring 34 is then also sown onto each of the hoops 31-1 and 31-2 at one of these fastenings of strips 33 to provide a convenient attachment for the respective swivel clips 23 as each of the strap combinations 11-1 and 11-2 are stretched between the axle AX and the thighs of the user, with each strap 21 and its adjustment buckle 22 enclosed by a fabric sheath 27 to protect against chafing.

It will be appreciated that the foregoing dimensional hoop limit of each of the thigh engaging hoops 31-1 and 31-2 effectively confines their locations adjacent the knees by virtue of the typical dimensional taper of the thigh. At the same time the looped configuration of each of the resistance producing strap combinations 11-1 and 11-2 allows for a wide range of resistive tension originating from the rear wheel axle, thus conveniently allowing for a wide range of exercise levels with the tensioning vector consistently well defined by the bicycle geometry. From this well defined resistance generating framework a training program of increasing resistance levels can then be devised in order to increase the muscle group natural pedaling rate, thus increasing the competitive level.

An opposing set of retaining hooks 41-1 and 41-2 are each cantilevered outwardly from the bicycle frame BF to provide a convenient set of attachments of the swivel clips 23 once these are disengaged from the respective D-rings 34, stretching the straps 21 within their respective sheaths 27 while retaining their most recent tension settings determined by the cam buckles 22. Thus a minimal time increment is incurred in the training process to obtain a measured comparison of the most recent pedaling rate achieved, thereby enabling a well defined training regiment by which the natural pedaling rate is increased as result of preferential muscular development within the muscle array devoted to this effort.

Figure 5:
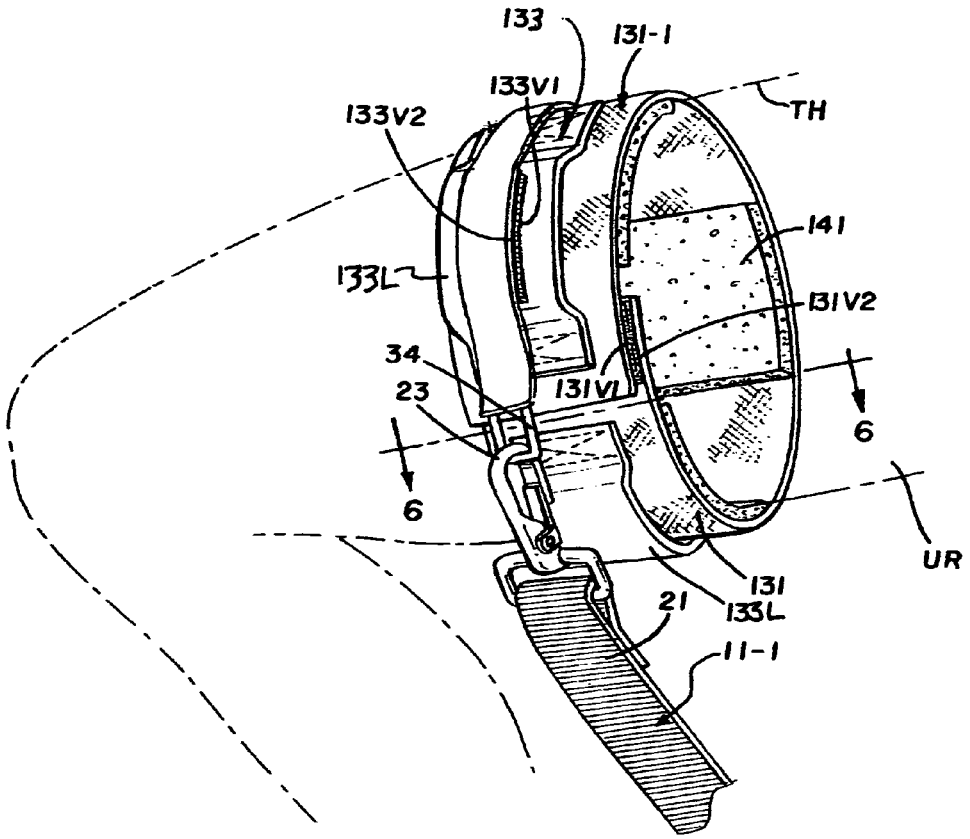
FIG. 5 is a further perspective illustration of the inventive restraint assembly mounted on the exterior of an inventive intermediate elastomeric fabric wrap conformed to engage in tension the substantial exterior of a user's thigh.
Figure 6:
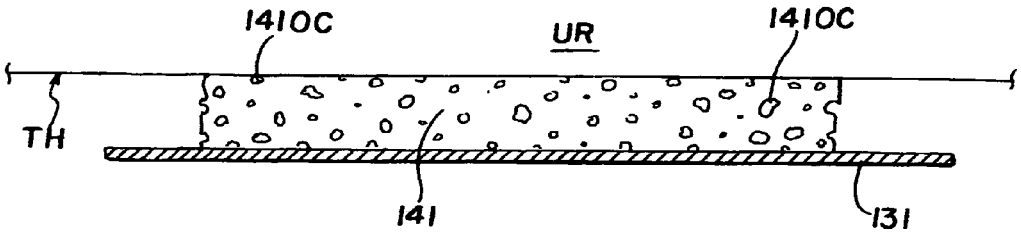
FIG. 6 is a sectional view taken along line 6-6 of FIG. 5, illustrating the interface between the user's thigh surfaces and one of a plurality of sponge pads affixed to the interior of said elastomeric wrap.
Figure 7:
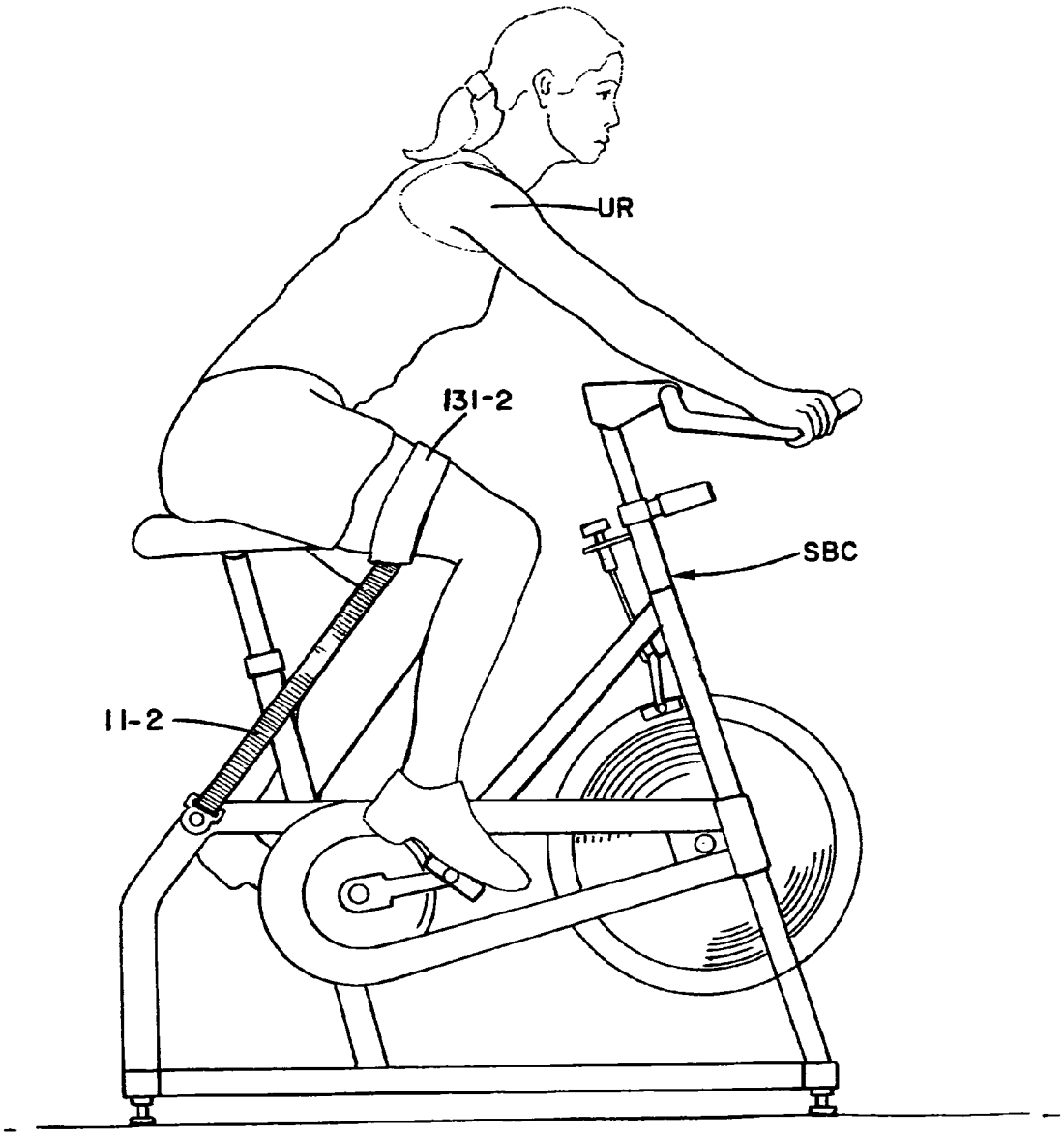
FIG. 7 is a further side view of a stationary exercise bicycle including the inventive exercise restraint.

For those instances where difficulties are encountered in maintaining the respective hoops 31 at their selected positions on the thighs of the user UR, i.e., in those instances where the thigh musculature fails to define a distinct reduction or taper in its section close to the user's knees, an intermediate set of mounting wraps 131-1 and 131-2 are provided, as illustrated in FIGS. 5 through 7. Both the wraps, described herein in detail by particular reference to the wrap 131-1 (the other wrap 131-2 being similarly implemented) includes a generally rectangular elastomeric fabric panel 131 having the transverse edges thereof adhesively bonded to the opposing segments 131V1 and 131V2 of a hook and pile releasable securing mechanism generally known Velcro and are thereby conformed to be wrapped in tension about the user's thighs TH to span axially over most of its length.

Similar to the hoops 31, the elastomeric panel 131 of each of the wraps 131-1 and 131-2 is limited in its maximum elastic extension by corresponding strips 133 sown in convolved loops 133L to the exterior surface thereof with the exteriors of these loops having adhered thereto segments 133V1 of yet another hook and pile securing mechanism with the complementing segments 133V2 then adhered in generally corresponding spacing to the underside of the elastomeric straps 31 forming the respective hoops 31-1 and 31-2. Of course, once so secured the respective D-rings 34 carried on each of the hoops can then be engaged to the respective swivel clips 23 in a manner like that previously described.

The inside surfaces of each of the elastomeric fabric panels 131 are then each provided with a plurality of generally flat, spaced sponge pads 141 that are each sown to the panel in an alignment presenting their large faces that including the exposed openings 141OC therein for intimate contact with the user's skin, the edges of each opening thus enhancing the shear load capacity at each such contact while also providing the pathways for absorbing any sweat produced during exercise. In this manner the utility of the instant restraint system may be expanded over a wide range of musculatures and also to prolonged exercise routines like those carried out on a stationary bicycle SBC.

All these foregoing advantages are conveniently achieved in an assembly that is simple to produce, easily attached to a bicycle structure and is well shielded by fabric sheaths to minimize any possible sources of inadvertent contact. This simplicity and inherent safety are particularly useful in a self-training program in which the commercially available bicycle speed sensing equipment can provide a measurement reference for the training's success.

Obviously many modifications and variations of the instant invention can be effected without departing from the spirit of the teachings herein. It is therefore intended that the scope of the invention be determined solely by the claims appended hereto.

It is claimed:

1. An exercise restraint assembly for use with a bicycle, the exercise restraint assembly comprising:

a pair of hoops, where each hoop is an elastomeric strap configured to be fitted over a thigh of a rider using the bicycle;

a connecting ring attached to each hoop of the pair of hoops; and a pair of elastic elastomeric straps, each elastic elastomeric strap providing a resistive tension to the thighs of the rider using the bicycle as pedals of the bicycle are moving upward and rebound energy as the pedals are moving downward, and comprising a first connecting means at a first end of each elastic elastomeric strap for connecting to the respective hoop, and a second connecting means comprising a washer at a second end of each elastic elastomeric strap for connecting to a rear frame portion of the bicycle.

2. The exercise restraint assembly of claim 1, where the bicycle is a conventional bicycle comprising a front wheel, a rear wheel, a handle bar, a crankset and pedals, a seat, a seatpost, and a frame comprising a top tube, a head tube, a fork, a down tube, a seat tube, a pair of seat stays, a pair of chain stays, and a rear derailleur hanger.

3. The exercise restraint assembly of claim 2, where the second connecting means is a washer having a hole that fits over a rear axle of the rear wheel of the bicycle and a metal circlip that holds the washer in place.

4. The exercise restraint assembly of claim 2, where each elastic elastomeric strap further comprises a spring-loaded cam buckle having a slot through which either the first end or the second end of each elastic elastomeric strap is returned and then adjustably positioned and held in place.

5. The exercise restraint assembly of claim 2, where each elastic elastomeric strap further comprises a hook-and-loop fastener configured to allow a length of each elastic elastomeric strap to be repositioned and adjusted.

6. The exercise restraint assembly of claim 1, where each hoop comprises at least one fabric strip attached to the hoop to form at least one loop and a D-ring held in place by the loop.

7. The exercise restraint assembly of claim 6, where the first connecting means is a swivel clip configured to be attached to the at least one loop.

8. The exercise restraint assembly of claim 1, where each hoop comprises a first end, a second end, and a spring-loaded cam buckle attached to the second end and having a slot through which the first end of the hoop is returned and then adjustably positioned and held in place.

9. The exercise restraint assembly of claim 1, where each hoop comprises a first end, a second end, and a hook-and-loop fastener comprising a hook fabric strip attached to the first end and a loop fabric strip attached to the second end.

10. The exercise restraint assembly of claim 2, further comprising a pair of retaining hooks attached to the seat tube of the frame and cantilevered outwardly therefrom so as to accept and retain the swivel clips whenever the swivel clips are not connected to the rings of the hoops.

11. The exercise restraint assembly of claim 1, where the bicycle is a stationary or exercise bicycle comprising a saddle, a form of handlebar, a pair of pedals, a frame comprising a front portion and a rear portion, and a mechanism for applying resistance to the pedals.

* * * * *